United States Patent [19]

Grohmann

[11] Patent Number: 4,818,177

[45] Date of Patent: Apr. 4, 1989

[54] CENTRIFUGAL PUMP WITH INTEGRAL SUCTION VALVE

[75] Inventor: Martin Grohmann, Brunn Am Gebirge, Austria

[73] Assignee: Dresser Industries, Inc., Dallas, Tex.

[21] Appl. No.: 940,451

[22] Filed: Dec. 10, 1986

[51] Int. Cl.[4] ..... F04D 15/00; F04D 1/12

[52] U.S. Cl. ..... 415/49; 415/88

[58] Field of Search ..... 415/42, 29, 49, 88, 415/148, 150, 151, 156, 157, 167

[56] References Cited

U.S. PATENT DOCUMENTS 3,477,383 11/1969 Rawson et al. ..... 415/88

3,515,494 6/1970 Proni ..... 415/88

*Primary Examiner*—Henry Bennett

[57] ABSTRACT

An improved centrifugal pump is provided wherein a suction valve is integrally mounted within the impeller housing. The valve is shifted to the open position by hydraulic action and is preloaded by a spring to the closed position. Mechanical linkage is also provided to manually shift the valve between the open and closed positions.

9 Claims, 2 Drawing Sheets

CENTRIFUGAL PUMP WITH INTEGRAL SUCTION VALVE

TECHNICAL FIELD

This invention relates to pumps, and more particularly to an integral suction valve for a submersible or line shaft centrifugal pump.

BACKGROUND ART

Submersible or line shaft centrifugal pumps are currently used in a number of applications. One common application involves the use of a centrifugal pump to remove ("strip") a liquid cargo from a marine vessel, such as a tanker ship.

It is a common practice to mount marine cargo pumps such that the impeller rotates about a vertical axis and is driven by a vertical shaft extending to and above the surface of the liquid cargo. A pipe is provided to carry the pumped liquid, and this pipe also serves to enclose and support the vertical shaft. The impeller and its associated inlet apparatus are located as close to the bottom of the tank as possible to minimize the sump depth.

Another requirement for marine cargo pumps is that liquid inside the pump and attached piping system be prevented from draining back into the tank whenever the pump is stopped. Drained back liquid presents a severe cleaning problem when the type of cargo in a specific tank is to be changed, because the tank has to be cleaned of the old product and whatever amount that remains is difficult to store and finally dispose of. In addition, in marine applications a short down time for washing is required.

It is also important that the pump be stopped the moment it loses suction due to an empty tank. If the pump is not stopped immediately, it begins to operate dry, causing damage to its internal bearings. Depending on the type of cargo, the pump may lose suction a number of times during the cargo stripping operation as liquid slowly drains to the tank sump. Thus, the pump must be easily restartable after a loss of suction.

It is known in the art to provide a separate butterfly valve attached to the bottom of a marine cargo pump. The prior art butterfly valve is an off-the-shelf purchased item which has not been optimally designed for use with centrifugal pumps in marine cargo stripping operations.

The prior art butterfly valve and pump combination suffers from a number of drawbacks. The total axial length of the pump and butterfly valve combination is greater than necessary due to the fact that the butterfly valve assembly is a purchased addon item and not integrally built into the pump. In addition, the amount of time required to close the prior art butterfly valve is relatively long, because the valve must rotate around its axis. A portion of the butterfly valve thus has to move opposite the flow direction. Dirt or other contamination can easily jam the butterfly valve so that it cannot easily be turned. Butterfly valves are notorious for being difficult to tightly seal in dirty liquid environments. Matching problems between flow through the butterfly valve and flow to the pump are common. Inlet flow to the impeller is disturbed, which deteriorates the efficiency of the impeller.

SUMMARY OF THE INVENTION

The afore-mentioned deficiencies in the prior art are eliminated by the present invention, which includes a spring loaded suction valve integral with, that is, within the same housing, with the pump impeller. In the preferred embodiment, the suction valve includes a floating disk preloaded by a spring for quick closing against a resilient seal located around a circular inlet. A mechanical opening/closing linkage is provided for safety in the event that the floating disk becomes jammed. The valve design is integrated into the suction housing, and therefore may be considered in the total hydraulic design of the pump.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION

Figure 1:
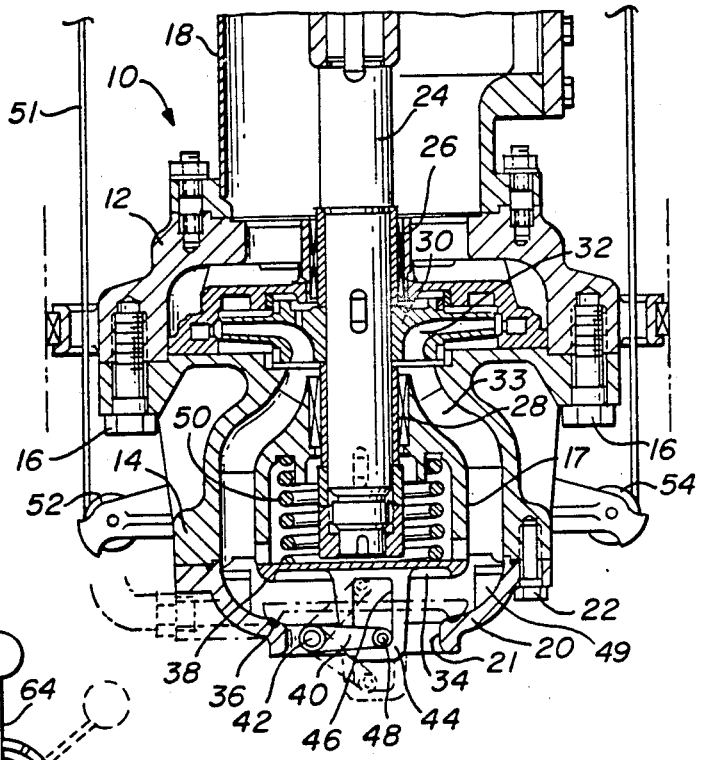
FIG. 1 is a partially broken away side view of the suction housing of a pump incorporating the present invention.

Referring initially to FIG. 1, pump 10 includes upper pump housing 12 and lower pump housing 14 connected by bolts 16. Pipe 18 is connected to upper housing 12, and it will be understood that only the lowermost portion of pipe 18 is illustrated in FIG. 1. Pipe 18 in the typical application is quite lengthy, extending from the bottom of the cargo tank to above the full surface level of the tank. Lower housing 14 includes inner lower housing 17 spaced inwardly therefrom to form inlet passageways. Cylindrical walls in housing end 20 define a circular inlet opening 21. Housing end 20 is connected to lower housing 14 by means of bolts 22.

Shaft 24 extends to the surface through pipe 18 and is supported by bearings 26 and 28 in the pump housing. Impeller 30 is fixed for rotation with shaft 24. Impeller 30 includes flow passageways 32 to enable centrifugal pumping. Vanes 33 are provided between lower housing 14 and inner lower housing 17 to guide fluid flow to passageways 32 in impeller 30.

The suction valve of the present invention includes disk-shaped closure element 34 mounted for movement within the housing defined by upper housing 12, lower housing 14 and housing end 20. Closure element 34 is movable between an open position shown in FIG. 1 and a closed position shown in dotted lines in FIG. 1. A resilient seal 36 is retained by housing end 20 around inlet opening 21. Lip 38 on closure element 34 is provided for engagement with resilient seal 36.

The mechanical opening/closing linkage includes bell crank lever 40 pivotally mounted at pivot point 42. A centrally located arm 44 on closure element 34 includes an elongated slot 46. Bell crank 40 includes a finger 48 at one end thereof which engages slot 46 in arm 44.

Fins 49 in housing end 20 provide radial containment for closure element 34. Compression spring 50 is provided to preload and bias closure element 34 towards the closed position. Closure element 34 is therefore free to "float" between the open and closed positions depending on hydraulic conditions in the pump. Cable 51 and pulleys 52 and 54 are provided for use in connection with the opening/closing linkage, which will now be described with reference to FIG. 2.

Figure 2:
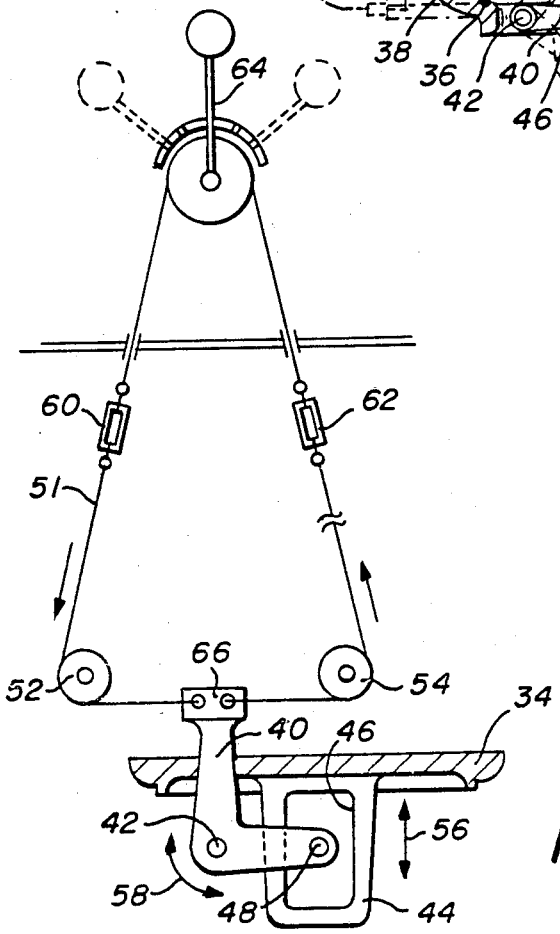
FIG. 2 is a schematic view of the mechanical open/-closing linkage of the invention.

Bell crank lever 40 and closure element 34 are shown in schematic fashion in FIG. 2, with their relative movements indicated by arrows 56 and 58. Cable 51 extends above the tank in which the pump is mounted by way of turnbuckles 60 and 62 to a pivoted handle 64. The ends of cable 51 are attached to end 66 of bell crank lever 40.

In operation, closure element 34 provides a floating disk valve with spring 50 preloading the disk for closing. Handle 64, cable 51 and bell crank lever 40 provide a mechanical opening/closing linkage for safety in case closure element 34 becomes jammed. As shown in FIG. 2, handle 64 can be moved in either direction from vertical to either open or close the valve. When handle 64 is vertical, closure element 34 is free to be in either the closed or open position depending on the dynamic state of the pump.

The suction valve is integrated into the suction bell formed by lower housing 14 and housing end 20. This key feature of the invention results in a short axial length, a distinct advantage when discharging liquids stored at vaporization temperature. Under such conditions, the static liquid head between the liquid surface and the centerline of the impeller represent a substantial part of the available NPSH. In addition, the short axial length minimizes the liquid remaining in the sump of the tank after the stripping operation. The integration of the suction valve into the suction bell also enables the hydraulic design to be maximized such that an excellent velocity profile for inlet flow to the impeller may be provided.

The biasing preload provided by spring 50 accelerates movement of closure element 34 to the closed position the moment the pump is stopped, thereby limiting backflow to the fullest extent possible. In the marine environment, liquid products tend to be relatively dirty, so the provision of spring 50 also prevents closure element 34 from jamming in the open position.

When the pump is stopped, or the liquid level in the tank drops below opening 21, closure element 34 closes immediately due to the combined force of spring 50, the internal static liquid head and the weight of closure element 34. Consequently, the liquid in the pump and the piping above the pump cannot drain back into the tank. A drain pipe may be provided to discharge the liquid within the pump and piping by means of compressed air or nitrogen gas.

The pump filled with liquid and sealed by the closed suction valve is easy to restart in the situation where remaining liquid is draining slowly to the tank sump. Once the pump is restarted, the impeller immediately creates suction due to the surrounding liquid. The pump is kept operating in the surrounding liquid, which avoids dry running of the pump.

While only one embodiment of the present invention has been described in detail herein and shown in the accompanying Drawings, it will be evident that various further modifications are possible without departing from the scope of the invention.

I claim:

1. In a centrifugal pump, wherein an impeller is mounted for rotation within a housing having an inlet opening, the improvement comprising:

the housing having an outer housing portion defining a circular inlet opening, said housing further having an inner housing portion within the outer housing portion, the inner and outer housing portions defining an annular passage from the circular inlet opening to the inlet of the impeller, said inner housing portion defining a cavity facing the circular inlet opening;

a closure element mounted within the outer housing portion for movement between an open position and a closed position, said closure element being a discharged member constrained for linear motion by the housing between the open and closed positions;

means for sealing the inlet opening in cooperation with the closure element when said closure element is in the closed position;

a spring received in the cavity for biasing said closure element against said means for sealing; and said means for biasing providing sufficient biasing force to cause said closure element to move to said closed position when no liquid is available to be drawn in the housing to minimize backflow, yet allow said closure element to move to the open position when rotation of the impeller causes liquid to be drawn into the housing through the inlet opening and the closure element being mounted in the housing whereby the separation between the inlet opening and impeller is minimized to reduce the static head between the inlet opening and impeller.

2. In a centrifugal pump, wherein an impeller is mounted for rotation within a housing having an inlet opening, the improvement comprising:

closure element mounted within the housing for movement between an open position and a closed position;

means for sealing the inlet opening in cooperation with said closure element when said closure element is in the closed position;

means for biasing said closure element against said means for sealing;

said means for biasing providing sufficient biasing force to cause said closure element to move to said closed position when no liquid is available to be drawn in the housing, yet allow said closure element to move to the open position when rotation of the impeller causes liquid to be drawn into the housing through the inlet opening; and a linkage for mechanically shifting said closure element to the closed position form the open position.

3. The improvement of claim 2 comprising a pivoted bell crank lever connected to said closure element and connected to means for receiving an operator signal to shift said closure element.

4. The improvement of claim 3 comprising a cable attached to an arm of said bell crank lever and attached to a pivoted handle remotely located from said lever.

5. The improvement of claim 1 wherein said spring for biasing includes a captive compression coil spring acting on one side of said disk-shaped member.

6. The improvement of claim 1 wherein said disk-shaped member includes a circular lip, and said means for sealing includes a resilient seal retained by said housing around the circular inlet opening.

7. In a centrifugal pump, wherein an impeller is mounted for rotation within a housing having an inlet opening, the improvement comprising:

a closure element mounted within the housing for movement between an open position and a closed position;

means for sealing the inlet opening in cooperation with said closure element when said closure element is in the closed position;

means for biasing said closure element against said means for sealing;

said means for biasing providing sufficient biasing force to cause said closure element to move to said closed position when no liquid is available to be drawn in the housing, yet allow said closure element to move to the open position when rotation of the impeller causes liquid to be drawn into the housing through the inlet opening;

said closure element being a disk shaped member constrained for linear motion between the open and closed positions; and said closure element being connected to a mechanical linkage for shifting said closure element between the open and closed positions.

8. The improvement of claim 7 wherein said mechanical linkage includes a pivoted bell crank lever mounted to said housing and connected to said disk-shaped member by means of walls defining an opening on said disk-shaped member.

9. The improvement of claim 8 further comprising a cable extending to a remote location for manipulation by an operator and connected to said bell crank lever to impart closing and opening motion to said disk-shaped member.

* * * * *